US007954357B2

(12) United States Patent
Bradley et al.

(10) Patent No.: US 7,954,357 B2
(45) Date of Patent: Jun. 7, 2011

(54) DRIVER PLATE FOR ELECTROMAGNETIC FORMING OF SHEET METAL

(75) Inventors: John R. Bradley, Clarkston, MI (US); Glenn S. Daehn, Columbus, OH (US)

(73) Assignees: GM Global Technology Operations LLC, Detroit, MI (US); The Ohio State University Research Foundation, Columbus, OH (US)

( * ) Notice: Subject to any disclaimer, the term of this patent is extended or adjusted under 35 U.S.C. 154(b) by 837 days.

(21) Appl. No.: 11/867,734

(22) Filed: Oct. 5, 2007

(65) Prior Publication Data

US 2009/0090162 A1 Apr. 9, 2009

(51) Int. Cl.
*B21D 26/00* (2006.01)

(52) U.S. Cl. ..... 72/466.8; 72/54

(58) Field of Classification Search ..... 72/54, 57, 72/60, 63, 430, 465.1, 466, 466.8
See application file for complete search history.

(56) References Cited

U.S. PATENT DOCUMENTS

| | | | | |
|---|---|---|---|---|
| 3,618,350 | A | 11/1971 | Larrimer, Jr. et al. | |
| 7,069,756 | B2 | 7/2006 | Daehn | |
| 7,076,981 | B2 | 7/2006 | Bradley et al. | |
| 7,550,189 | B1 * | 6/2009 | McKnight et al. | 72/59 |

OTHER PUBLICATIONS

W.H. Larrimer, Jr. and D.L. Duncan, "Transpactor-A Reusable Electromagnetic Forming Tool . . . ", Technical Paper, 1973, pp. 1-14, Society of Manufacturing Engineers, Dearborn, MI.

* cited by examiner

*Primary Examiner* — Teresa M Ekiert
(74) *Attorney, Agent, or Firm* — Reising Ethington P.C.

(57) ABSTRACT

A multi-layer driver plate is disclosed for use in electromagnetic sheet metal forming operations. In one embodiment, the driver plate comprises a first layer characterized by low electrical resistivity and thickness for inducement and application of a suitable electromagnetic forming force, a second layer comprising an elastomeric material for compressing a sheet metal workpiece against a die surface and then regaining its original pre-forming structure, and a third layer interposed between the first layer and the second layer to protect the EMF force providing layer and to provide overall strength and durability to the EMF driver plate.

14 Claims, 2 Drawing Sheets

DRIVER PLATE FOR ELECTROMAGNETIC FORMING OF SHEET METAL

TECHNICAL FIELD

This invention pertains to electromagnetic forming operations in which a thin sheet metal workpiece is driven at high velocity against a forming surface. More specifically, this invention pertains to the use of a laminated driver plate with an elastomeric layer for contacting the sheet metal and momentarily deforming with it as it is shaped against the forming surface.

BACKGROUND OF THE INVENTION

Sheet metal forming processes are known in the art and typically include forcing a sheet metal workpiece against a forming tool surface, sometimes called a die surface. In electromagnetic forming (EMF) of sheet metal the workpiece is rapidly propelled by a momentary electromagnetic force over a short distance against the forming surface at velocities far in excess of those found in a conventional stamping technique. Typically, the movement and deformation of the workpiece is completed within a few tens of microseconds. EMF is usually applied to sheet metal workpieces that have typical sheet or foil thicknesses up to about 3 millimeters thick and frequently to workpieces less than one-half millimeter in thickness.

In a practice of EMF, a low electrical resistivity (e.g., less than about 0.15 micro-ohm meter) sheet metal workpiece is positioned close to or against a forming tool surface. Such materials include, for example, sheets of copper, aluminum, and some of their alloys. For example, an inductive coil electromagnetic actuator is used. It is positioned close to the opposite side of the highly conductive sheet metal. A strong electrical current is discharged through the windings of the coil to generate, momentarily, a strong electromagnetic field. That field induces an opposing electrical current in the workpiece. The opposing magnetic fields between the stationary coil and the workpiece sheet accelerate the workpiece to a high velocity and upon impact it stretches the sheet into conformance with the tool surface. As an example, U.S. Pat. No. 7,076,981 describes a use of electromagnetic forming in shaping networks of serpentine flow passages in thin metal flow field plates for a hydrogen/oxygen fuel cell.

In some instances, the desired sheet metal workpiece may lack suitable electrical conductivity to respond to the magnetic field and be driven against the forming surface by the discharge of the electromagnetic actuator. In this situation, a low resistivity driver plate may be placed between the electromagnetic actuator and the sheet metal. The driver plate reacts to the electromagnetic field and drives the sheet metal against the forming surface. Both the driver plate and the metal workpiece are permanently deformed in the process. So the driver plate must be separated from the formed product and either discarded or recycled, and the shaped sheet metal product is advanced to the next stage in its manufacturing process.

Electromagnetic forming can achieve strain rates of the order of $10^5$ $sec^{-1}$ and sheet velocities in the range of 50 to 300 m/s. Such strain rates in sheet metal workpieces may improve the formability of the workpiece material. The high strain rates may increase the ability to make sharp and deep features in the workpiece while decreasing spring-back of the formed sheet and wrinkling of its features. Thus, there is a need for a means of conducting electromagnetic forming of sheet metal materials of higher electrical resistivity without having to use and discard (or restore to their original flat condition) low resistivity driver plates after each forming operation.

SUMMARY OF THE INVENTION

A new multi-layer driver plate is provided for use in EMF sheet metal forming operations. The driver plate comprises an elastomeric layer for engaging a surface of a sheet metal workpiece and driving the opposite surface of the workpiece against the forming features of a die or other suitable forming surface. The driver plate also comprises a low electrical resistivity layer for reacting to a momentary electromagnetic field of suitable strength and driving the elastomer layer against the workpiece in the forming operation. The driver plate includes a rigid layer for structural support between the low resistivity layer and the elastomer layer. The respective layers may be attached or unattached as necessary in a particular application, but the three layers cooperate in their driver plate function in repeated forming actions on a sheet metal workpiece or forming actions on a succession of many workpieces. In one example, the low electrical resistivity layer is attached to the rigid layer and the rigid layer is attached to the elastomer layer. In another example, the low electrical resistivity layer is attached to the rigid layer but the rigid layer is not attached to the elastomer layer.

The driver plate may have a general shape that is complementary in area (i.e., plan view) and elevational contour or profile to the forming surface of the forming tool for the sheet metal workpiece. A typical EMF forming tool has forming features that extend a small distance, e.g., a millimeter or so, above the general profile of the tool surface. For example, each plate member of a bipolar plate for a PEM hydrogen/air fuel cell is generally flat with long, sometimes rounded, gas flow channels formed in a serpentine pattern and extending a millimeter or so above (or below) the un-deformed plane of the plate (which is often less than 0.5 mm thick). In such an application, the layers of the driver plate may be substantially flat. In other forming applications, the shape of article may be somewhat arcuate, like a bent (but untwisted) ribbon. In this application, the driver plate may have a curved shape complementary to the profile of the forming tool and like the general configuration of the sheet metal article to be formed.

The multi-layer driver plate has a layer of elastomeric composition and thickness for engaging the surface of the thin sheet metal and driving it against the surface of the forming tool and stretching the metal into conformance with the forming surface. While the thickness of the sheet metal may be about one-half millimeter or less, upstanding or recessed features of the forming surface may have dimensions of a millimeter or more. The workpiece-contacting surface of elastomeric layer of the driver plate accommodates this shaping of the sheet metal by suitably flexing and deforming to push the sheet metal into conformance with the die surface. The thickness of the elastomer layer will usually be greater than the height of elevated or recessed features of the forming surface to flex, deform and force the sheet metal workpiece into and against the metal shaping features of the forming surface. The elastomer layer may be initially flat, or may have the basic contours of the part to be manufactured. This may reduce the strain in the elastomer and increase its lifetime in service. Whether flat or contoured, the ability of the elastomer layer to deform reduces the requirement for precise alignment of the driver plate and forming tool.

The driver plate further comprises a more rigid layer attached to, or simply positioned to engage, the backside of the elastomeric layer. This layer provides the structural integrity of the multilayer plate, especially when the forming operation requires substantial EMF force to suitably shape the workpiece. It may comprise a strong material such as steel or other metal. In other embodiments, a reinforced polymeric or ceramic composite may be devised. In the forming of the sheet metal, a sudden impulsive force is transmitted to the structural layer. This sudden, momentary force is transmitted by the rigid layer to the elastomeric layer to drive the sheet metal against its forming surface.

The driver plate further comprises a low electrical resistivity layer which, preferably, is in the form of a continuous sheet, foil, or film depending on the power requirements of the driver plate. This layer comprises a low resistivity metal such as aluminum, copper, gold, silver, or the like. This low resistivity layer is applied to the exposed side of the rigid layer of the multilayer driver plate and may be less than one millimeter thick in embodiments in which an equally thin (or thinner) sheet metal workpiece is to be formed. In some embodiments the low resistivity layer may be electroplated on the rigid layer. The thickness of this electromagnetically responsive layer may often depend on the thickness and formability of the workpiece because the driving force for the forming operation is electromagnetically induced in this low resistivity layer of the driver plate. Increased thickness and area of the layer (together with lower resistivity) accommodates the creation of a greater force for deformation of the workpiece.

The multilayer driver plate is shaped to have a contact surface area for the elastomer layer to contact a predetermined area or portion of the workpiece. The perimeter or plan view of the contact surface of the elastomer layer is made to overlie this area of a workpiece surface to be formed by the driver plate. In many embodiments of the invention the corresponding plan view shapes of the rigid structural layer and of the low resistivity, EMF driver layer will coincide with the shape of the elastomer layer. The respective thicknesses of the layers depend on their individual performance requirements but, in many embodiments of the invention, their edges coincide with a common edge(s) for the driver plate.

In a forming operation, the three-layer driver plate is placed with its elastomer layer next to the sheet to be formed, or at an appropriate standoff distance from the sheet to be formed to allow for the driver plate to impact the sheet at a high velocity, with its low resistivity layer outward to receive an electromagnetic impulse from a suitable electromagnetic field generator or actuator. The intense electromagnetic repulsion between the actuator and the low resistivity layer of the driver plate forcibly propels the driver plate against a sheet metal workpiece driving it at high velocity against a forming surface.

The elastomeric layer of the driver plate is momentarily deformed as it drives the sheet metal workpiece against its forming surface. The more rigid structural layer of the driver plate may flex during the brief and forceful impact but it is sized and made of a material to retain the desired configuration of the multilayer driver plate. The rigid layer also carries and isolates the low resistivity layer from permanent distortion during the forming step.

Thus, the cooperative properties of each layer of the multilayer configuration allows the driver plate to deform a sheet metal workpiece against a profiled die surface and return to its original pre-forming structure. The ability to participate in electromagnetic sheet metal forming operations without sustaining substantial or permanent disfiguration allows the driver plate to be repeatedly used in high volume EMF forming operations instead of being replaced and recycled after each forming operation.

Other exemplary embodiments will become apparent from the detailed description. It should be understood that the detailed description and specific examples, while indicating the exemplary embodiments of the invention, are intended for illustration purposes only and not intended to limit the scope of the invention.

BRIEF DESCRIPTION OF THE DRAWINGS

The disclosure will now be described, by way of example, and not limitation, with reference to the accompanying drawings. The following is a brief description of the drawings.

DESCRIPTION OF PREFERRED EMBODIMENTS

The description of the following embodiment(s) is merely exemplary in nature and is in no way intended to limit the claimed invention, its application, or its uses.

EMF sheet metal forming techniques are useful in forming thin sheet metal workpieces and may be utilized either alone or in combination with more traditional metal forming techniques, such as stamping. A noted advantage associated with EMF metal forming is its ability to satisfactorily stretch metals at strain rates that would ordinarily cause tearing if performed by a conventional forming process. In fact, EMF can achieve strain rates of up to approximately $10^5$ $sec^{-1}$ and sheet velocities in the range of 50 to 300 m/s. A single deformation step of a sheet metal workpiece is completed within a few tens of microseconds or so. These capabilities make EMF well suited for shallow forming of thin metal sheets. For example, in one embodiment, an EMF forming operation may be employed to perform one or more steps in the manufacture of a fuel cell bipolar plate, which is briefly described below.

Figure 4:
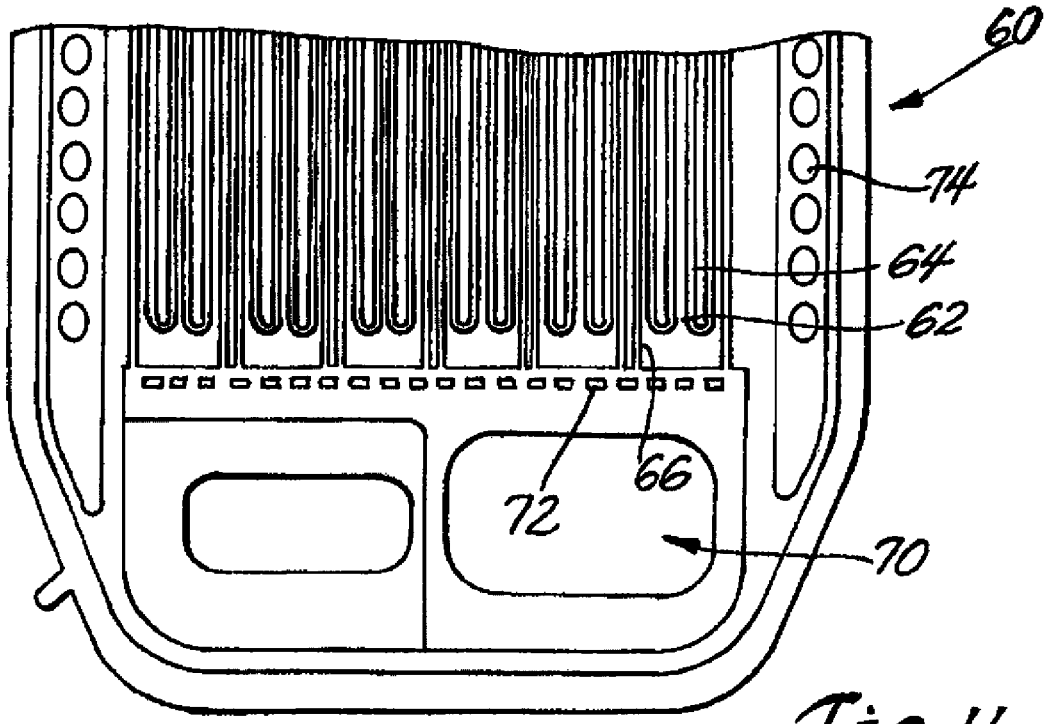
FIG. 4 is a partial plan view of a portion of a fuel cell bipolar plate that may be formed according to various embodiments of the invention.

A fuel cell bipolar plate is a thin metal component of intricate and complex shape that serves to evenly distribute reactant gases across a diffusion media found in fuel cells. FIG. 4 shows a partial view of a flow field surface of a representative fuel cell bipolar plate 60. This plan view illustrates the complex shapes and contours that may be fashioned by a high velocity metal forming operation. Here, the bipolar plate 60 comprises a plurality of lands 62 between a plurality of serpentine gas flow channels 64 formed into and situated across a face of the plate 60. Each flow channel 64 comprises a leg 66 that transports gas to or from common supply manifold 70 by way of a manifold groove 72. The plate 60 also comprises a plurality of coolant flow channels 74 that convey a cooling fluid across the opposing face of the plate 60. The structural features of bipolar plate 60 such as the flow channels 64 may be formed by EMF using a multilayer driver plate in accordance with this invention.

It should be noted that the fuel cell bipolar plate 60 described in FIG. 4 is merely illustrative of sheet metal articles that may be formed using the subject driver plate in an EMF operation.

Figure 1:
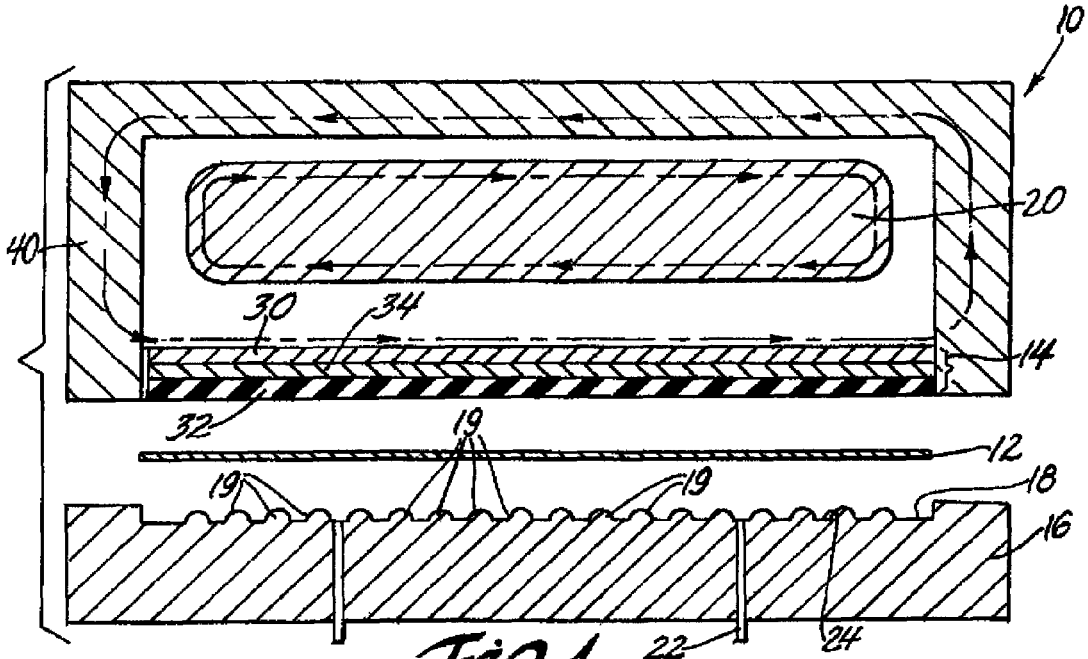
FIG. 1 is a schematic illustration of an EMF apparatus configured to form a sheet metal workpiece by electromagnetic forming, the apparatus being in an open position.

Referring to FIG. 1, an EMF sheet forming system 10 includes a sheet metal workpiece 12, a multi-layer driver plate 14, a forming tool 16 that comprises a profiled die surface 18, an electromagnetic actuator 20 (comprising a wound induction coil, not shown), and a capacitor bank (not shown). The sheet metal workpiece 12 may be a thin sheet of austenitic stainless steel, on the order of about 0.2 mm thick or less, that is to be formed, for example, into a bipolar plate component approximately a couple millimeters in height. The multiple elevated features 19 on the die surface 18 may be used, for example, for forming gas flow passages in a bipolar plate as illustrated in FIG. 4. The features 19 may extend as much as one to two millimeters above the generally planar profile of the die surface 18.

At the onset of the EMF process, sheet metal workpiece 12 is positioned adjacent the profiled die surface 18 and eventually secured to the forming tool 16 to prevent intolerable movement or shifting of the workpiece during forming. The system 10 may also be configured in an inverted orientation such that the workpiece 12 may be placed atop the driver plate 14 and held in place by gravity. The offset, or distance the workpiece must travel before striking the die surface 18, is established by equipment designs and dimensions. The forming tool 16 may be equipped with one or more conduits 22 to function with a vacuum system for preventing entrapment of air between the workpiece 12 and the die surface 18. Alternatively, the system 10 depicted in FIG. 1 may reside in an evacuated chamber to eliminate the issues regarding trapped air.

When the specified sheet metal workpiece 12 exhibits a relatively high electrical resistivity, as is the case with an austenitic stainless steel sheet, a multi-layer driver plate 14 may enhance the effectiveness of the forming operation. For EMF systems 10, it may be beneficial to utilize the multi-layer 14 driver plate if the sheet metal workpiece 12 exhibits an electrical resistivity of approximately 0.15 μohm-m and above.

The multi-layer driver plate 14 may be interposed between the sheet metal workpiece 12 and the electromagnetic actuator 20 and may have an overall thickness of several millimeters or so. The driver plate 14 comprises a first layer 30 characterized by a low electrical resistivity so that the driver plate 14 is responsive to the magnetic field generated by the electromagnetic actuator 20. The first layer 30 is positioned adjacent the electromagnetic actuator 20 and may comprise materials such as, but are not limited to, aluminum, copper, gold, silver, and alloys thereof. Layer 30 is suitably in the form of a sheet, foil, or film depending on the force to be delivered by the driver plate 14.

The driver plate 14 further comprises a second layer 32 of suitable thickness of a deformable elastomeric material. The second layer 32 is shaped in area or plan view so that it suitably overlies the top surface of the portion of the sheet metal workpiece 12 that is to be formed against die surface 18. The elastic material is characterized by its ability to deform and push the workpiece 12 securely against the profiled die surface 18 in response to the electromagnetic force applied to the first layer 30, and then return to its original shape after the force subsides. The elastomeric second layer 32 may be thicker than the height of the elevated features 19 in die surface 18 around which second layer 32 will urge sheet metal workpiece 12. Furthermore, the strength and flexibility of the second layer 32 helps the entire driver plate 14 regain its original flat or contoured shape after each forming cycle as opposed to permanently deforming along with the metal workpiece 12 in accordance with the die surface 18. Thus, the elastomeric second layer 32 contributes to the overall ability of the driver plate 14 to participate in numerous EMF forming cycles without having to be replaced.

The deformable elastomeric material may comprise any suitable rubber or elastomer material that exhibits the type of strength and flexibility required to firmly compress the sheet metal workpiece against the profiled die surface 18 in response to an imparted electromagnetic force, while at the same time being able to regain its original shape upon abatement of the force. Known elastomeric compositions include, but are not limited to, natural rubber, suitable polymeric compositions of styrene-butadiene, butadiene, isoprene, ethylene-propylene, butyl, nitrite, chloroprene, silicones, fluorocarbon elastomers, polysulfide rubbers, acrylic elastomers, polyethers, and polyurethanes. An elastomer material for the driver plate may be obtained using one or more of these exemplary materials, or combinations of them. The thickness of the elastomeric layer in the driver plate is determined in each forming embodiment to be suitable for the EMF shaping of the sheet metal workpiece and returning to its pre-shaping configuration.

The driver plate 14 further comprises a third layer 34 sandwiched between the first layer 30 and the second layer 32 to provide overall strength, stiffness, and durability to the driver plate 14. The third layer 34 is more rigid than each of the first layer 30 and the second layer 32 and may achieve its required rigidity by being constructed of an appropriately rigid material or being present in a thickness sufficient to provide the necessary rigidity.

In the drawing figures, driver plate 14 is illustrated in an elevational cross-section so that its layers 30, 34, and 32 are shown in their respective positions. In these cross-sectional views it is to be understood that the thicknesses of layers 30, 34, and 32 are not necessarily (or even likely) the same and that the respective thicknesses may vary considerably from embodiment to embodiment of the invention. Further, the plan views of the layers 30, 34, and 32 of driver plate 14 are not illustrated in the drawing figures. In general, the plan view shape of elastomer layer 32 is a function of the shape of a surface area of a shape of a workpiece to be formed. The elastomer layer is shaped to suitably engage and deform the workpiece surface. In many embodiments of the invention the plan view shapes of the low resistivity layer 30 and rigid (or structural) layer 34 will coincide with the shape of elastomer layer 32 so that their combined and coincident edges define common edges or sides of driver plate 14.

Still referring to FIG. 1, the electromagnetic actuator 20 may comprise an inductive coil supported in a strong durable electrically conductive frame 40. The conductive frame in FIG. 1 results in a larger and more uniform forming pressure in addition to an overall electrically more efficient forming process. Alternative embodiments would make use of a more conventional EMF coil and workpiece arrangement in the absence of a return path for the induced current. It is contemplated that the inductive coil may be a multi-turn substantially helical coil that defines a variety of geometries such as, but not limited to, substantially circular, ellipsoidal, parabolic, quadrilateral, planar, and combinations thereof. The electromagnetic actuator may also be created from a flat spiral or other non-helical continuous current path, where the current runs in a single plane such as made by a wire or cut from a flat plate, and where no current return path is provided In communication with the actuator 20 is a capacitor bank (not shown) with related circuitry for passing a momentary high current pulse through the coils of the electromagnetic actuator 20.

Multilayer driver plate 14 is shown suspended within the side walls of conductive frame 40. In the pulsed operation of the electromagnetic actuator 20, an electrical current is momentarily generated as indicated by the dashed lines and arrows indicating a clockwise current in actuator 20. A counter-clockwise current is then momentarily induced in conductive frame 40 and low resistivity layer 30 of driver plate 14. As will be described below, the resulting opposed magnetic fields provide the driving force for the forming operation. This arrangement of primary and induced electric currents is illustrated in the relatively simplified view of FIG. 1 for clarity even though electromagnetic actuator is not activated with the EMF apparatus in the open position illustrated in FIG. 1.

Figure 2:
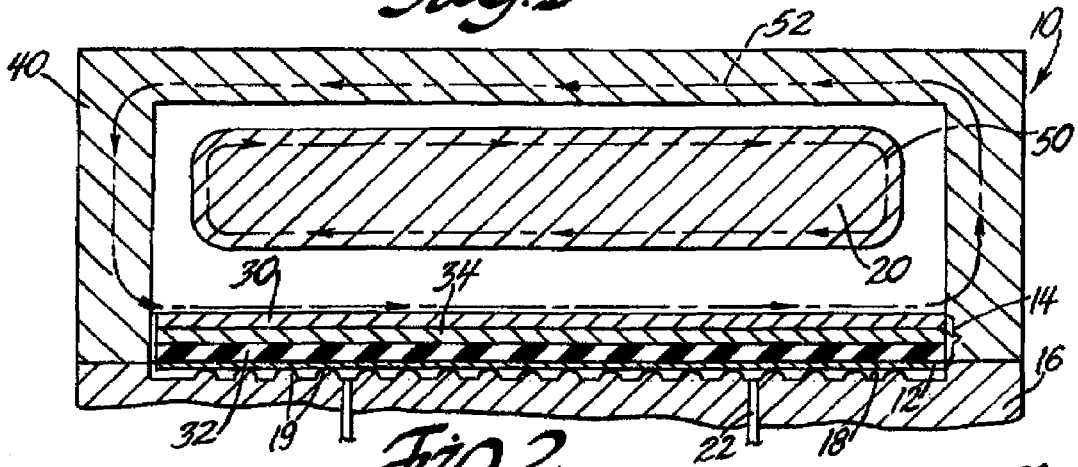
FIG. 2 is a schematic illustration of an apparatus configured to form a sheet metal workpiece by electromagnetic forming, the apparatus being in a closed position.

Referring now to FIG. 2, the EMF sheet forming system 10 is situated for forming after the sheet metal workpiece 12 and the multi-layer driver plate 14 have been properly aligned. This may comprise bringing forming tool 16 into engagement with the conductive frame 40 and then evacuating any air trapped between the sheet metal workpiece 12 and the profiled die surface 18.

The capacitor bank then discharges a high current pulse 50 through the electromagnetic actuator 20 typically using an ignitron or spark gap as a switch. Typically, the capacitor bank generates short, high voltage, high current electrical discharges that may measure upwards of hundreds of thousands of amperes. The result is a rapidly oscillating, very intense magnetic field which induces eddy currents 52 in the highly conductive first layer 30 of the driver plate 14. These eddy currents 52 travel through the first layer 30 of the driver plate and a portion of the conductive frame 40 and define a circuit that runs in a direction opposite the pulse through the actuator 20. Thus, the eddy currents 52 develop their own magnetic field that causes a mutual repulsion between the first layer 30 of the driver plate 14 and the electromagnetic actuator 20. The magnetic repulsion between the first layer 30 and the actuator 20 is strong enough to rapidly and forcibly thrust the driver plate 14 and the workpiece 12 against the profiled die surface 18 at a high velocity of about 50 to 300 m/s over a gap of approximately a few millimeters. The interactions between the driver plate 14 and the workpiece 12 that result from the electromagnetic force are described in more detail with reference to FIGS. 3A-3C.

Figure 3B:
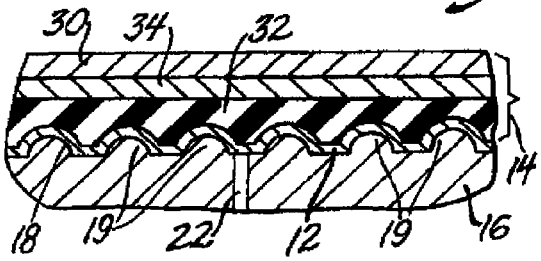
FIG. 3B is an enlarged sectional view of the interface between the die surface and the sheet metal workpiece during forming.
Figure 3A:
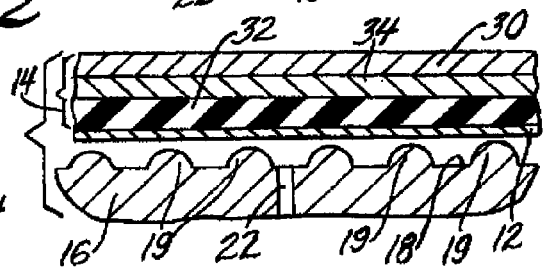
FIG. 3A is an enlarged sectional view of the interface between the die surface and the sheet metal workpiece prior to forming.
Figure 3C:
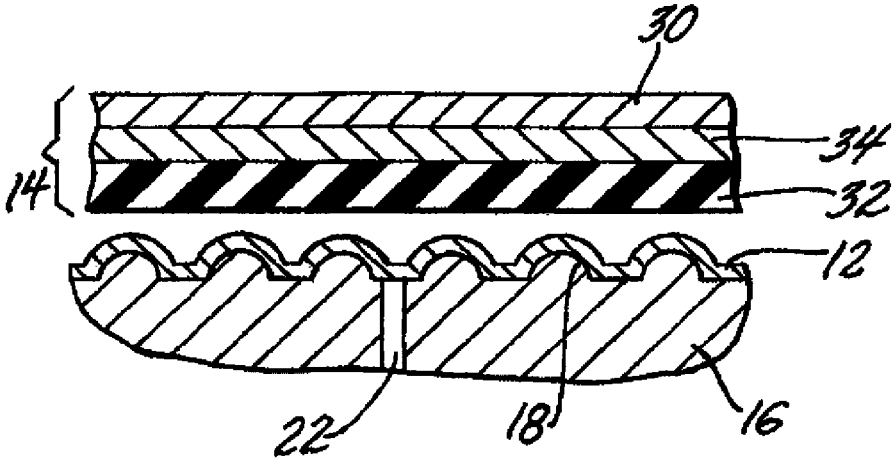
FIG. 3C is an enlarged sectional view of the interface between the die surface and the sheet metal workpiece subsequent to forming.

FIGS. 3A-3C represent enlarged sectional views of the surface interfaces between the profiled die surface 18, the sheet metal workpiece 12, and the multi-layer driver plate 14 at different stages in the EMF process. FIG. 3A depicts the orientation of the workpiece 12 and the driver plate 14 in relation to the profiled die surface 18 just prior to activation of the electromagnetic actuator 20. It can be seen that the second layer 32 of driver plate 14 that comprises an elastomeric material is positioned adjacent the sheet metal workpiece 12 on the side opposite the die surface 18. Sheet metal workpiece 12 is shown spaced from elevated features 19 in FIG. 3A to show a pre-forming position, but workpiece 12 may be laid on these elevated features 19 in preparation for the forming step. It is also contemplated that both the workpiece 12 and the elastomeric layer 32 could similarly be placed together on the elevated features 19, but separate from the other component layers of the driver plate, in preparation for the forming step. In this case the moving portion of the driver plate would be comprised of the low resistivity layer 30 and the rigid (or structural) layer 34. A potential advantage of this arrangement would be the mass reduction of the moving elements reacting to the repulsive forces generated between the coil 20 and the low resistivity layer 30. The elastomeric layer 32 uniformly contacts a substantial portion of the back surface of workpiece 12 to ensure the electromagnetic force generated by the electromagnetic actuator 20 is evenly transmitted by multilayer driver plate 14 and distributed across the face of the workpiece 12.

FIG. 3B illustrates the interactions that occur upon activating the electromagnetic actuator 20 to generate and induce opposing magnetic fields. As described earlier, the rapid discharge of an electric current through an inductive coil generates a repulsive magnetic force between the actuator 20 and the highly conductive first layer 30 of the driver plate 14. The thickness of layer 30 is in part a function of the magnetic force to be produced in it. This intense repulsive force vigorously thrusts the low resistivity layer 30 against rigid layer 34 of the driver plate 14. The rigid layer 34 resists substantial and permanent deformation of the conductive layer 30 and allows layer 30 to substantially maintain its original flat surface shape during deformation. In order to form the workpiece 12, however, the force imparted from the first layer 30 through rigid layer 34 is conveyed to the elastomeric layer 32 which compresses against the sheet metal workpiece 12 and deforms it in accordance with the profiled die surface 18. The thickness of elastomeric second layer 32 is suitably thicker than the height of forming features 19 from base portions of profiled forming surface 18.

Thus, the elastomeric layer 32 is substantially deformed and compressed to a large extent because the cooperating layers 32, 34 significantly maintain their original shape and therefore impart a consistent and uniform force against the elastomeric layer 32. As further shown in FIG. 3B, the force imparted to elastomeric layer 32 of the driver plate 12 is strong enough to overcome the yield strength of the sheet metal workpiece 12 and the result is a rapidly deformed workpiece now shaped in conformance with the die surface 18 and elevated features 19. It is also contemplated that several repeated current pulses may be discharged to fully press the workpiece 12 against the die surface 18 and elevated features 19, if necessary.

Following abatement of the electromagnetic actuator 20, as shown in FIG. 3C, the driver plate 14 retreats from the deformed workpiece 12 which remains firmly pressed against the profiled die surface 18. The strong magnetic force imparted to the elastomeric layer 32 from the conductive layer 30 and rigid layer 34 has subsided allowing elastomer layer 32 to decompress and return to its pre-forming size and shape, as originally shown in FIG. 3A. The restored multilayer driver plate 14 may be reused to deform a new sheet metal workpiece or it may be reused to repeat the EMF process on the same, previously deformed workpiece, if desired.

While exemplary embodiments of the disclosure have been described above, it will be recognized and understood that various modifications can be made by those of ordinary skill in the art. The appended claims are intended to cover all such modifications which may fall within the spirit and scope of the invention.

The invention claimed is:

1. A multilayer driver plate for use in electromagnetic forming of at least a portion of a sheet metal workpiece against a forming surface, the forming surface having elevated or recessed forming features with a maximum dimension from height to depth for shaping of the sheet metal workpiece, the driver plate comprising:

an elastomer layer comprising an elastomeric material; the elastomer layer having a surface for receiving a sheet metal forming force on one side of the layer; a sheet metal forming surface, with an un-deformed forming surface shape, on the other side of the layer; and a layer thickness that is greater than the maximum dimension of the forming features such that the sheet metal forming surface of the elastomer layer can momentarily engage and push a sheet metal workpiece into conformance with the forming surface by momentary deformation of the sheet metal forming surface of the elastomer layer, the forming surface of the elastomer layer returning to its un-deformed shape after shaping the sheet metal;

a metal layer having an electrical resistivity for periodic inducement of an electromagnetic force within the metal layer for electromagnetic forming of the sheet metal workpiece, the metal layer having a predetermined thickness based on a required induced electromagnetic forming force and being positioned for transmitting the induced electromagnetic forming force to the force receiving surface of the elastomer layer; and a support layer, more rigid than the metal layer, interposed between the elastomer layer and the metal layer.

2. A multilayer driver plate as recited in claim 1 in which the metal layer is attached to the support layer and the support layer is attached to the elastomer layer.

3. A multilayer driver plate as recited in claim 1 in which the three layers are co-extensive and their respective edges are aligned to form the edges of the driver plate.

4. A multilayer driver plate as recited in claim 1 in which the metal layer is attached to the support layer but the support layer is not attached to the elastomer layer.

5. A driver plate as recited in claim 1 wherein the elastomeric material comprises at least one of a natural rubber, a styrene-butadiene rubber, a butadiene rubber, an isoprene rubber, an ethylene-propylene rubber, a butyl rubber, a nitrile rubber, a chloroprene rubber, a silicone, a fluorocarbon elastomer, a polysulfide rubber, an acrylic elastomer, a polyether, or a polyurethane, or combinations thereof.

6. A driver plate as recited in claim 1 wherein the metal layer comprises at least one of aluminum, copper, gold, silver, or alloys thereof.

7. A driver plate as recited in claim 1 in which the thickness of the metal layer is equal to or greater than the thickness of the sheet metal workpiece.

8. A method of forming at least a portion of a sheet metal workpiece, the method comprising:

providing an electromagnetic actuator spaced opposite a forming surface that comprises forming elements extending above intervening base surfaces to a maximum height dimension, the electromagnetic actuator being configured to generate a magnetic field upon activation;

placing one side of the portion of the sheet metal workpiece adjacent a forming surface;

placing a multilayer driver plate against the opposite side of the portion of the sheet metal workpiece, the multilayer driver plate comprising a temporarily deformable elastomer layer with a thickness greater than the maximum height dimension of the forming elements of forming surface and a pre-engagement shape for engaging the opposite side of the workpiece, a low electrical resistivity layer situated adjacent the electromagnetic actuator and capable of experiencing a repulsive electromagnetic force sufficient to drive the elastomer layer against the sheet metal workpiece and force the workpiece into conformance with the profiled die surface upon activation of the actuator, and a support layer interposed between the elastomer layer and the low resistivity layer;

activating the electromagnetic actuator such that the repulsive electromagnetic force between the low resistivity layer and the actuator is of sufficient intensity to momentarily compress the elastomer layer against the opposite side of the portion of the sheet metal workpiece and drive the workpiece into conformance with the forming elements of the forming surface, the support layer preventing permanent deformation of the low resistivity layer; and abating the repulsive electromagnetic force between the low resistivity layer and the actuator to allow the elastomer layer to decompress and return to its pre-engagement shape.

9. A method of forming at least a portion of a sheet metal workpiece as recited in claim 8 further comprising removing the multilayer plate from engagement with the workpiece.

10. A method of forming at least a portion of a sheet metal workpiece as recited in claim 8 further comprising activating the electromagnetic actuator at least one more time to successively drive the sheet metal workpiece into conformance with the forming surface.

11. A method of forming at least a portion of a sheet metal workpiece as recited in claim 8 further comprising reusing the multilayer driver plate in a subsequent electromagnetic forming operation of a different sheet metal workpiece.

12. A method of forming at least a portion of a sheet metal workpiece as recited in claim 8 in which the forming surface comprises features defining gas flow channels for a fuel cell plate.

13. A method of forming at least a portion of a sheet metal workpiece as recited in claim 8 in which the forming surface comprises features defining gas flow channels for a fuel cell plate and the thickness of the sheet metal workpieces is no greater than one-half millimeter.

14. A method of forming at least a portion of a sheet metal workpiece as recited in claim 13 in which the forming surface features define gas flow channels with a depth of up to about two millimeters.

* * * * *